United States Patent [19]

Sobel

[11] 4,157,624

[45] Jun. 12, 1979

[54] PICTURE FRAME AND METHOD FOR MAKING SAME

[76] Inventor: David D. Sobel, 15415 N. 22nd St., Phoenix, Ariz. 85022

[21] Appl. No.: 765,994

[22] Filed: Feb. 7, 1977

[51] Int. Cl.[2] ..... G09F 1/12

[52] U.S. Cl. ..... 40/152.1; 40/155

[58] Field of Search ..... 248/489; 40/152, 152.1, 40/155; 403/401, 402, 205, 231

[56] References Cited

U.S. PATENT DOCUMENTS

| | | | |
|---|---|---|---|
| 2,450,495 | 10/1948 | Ullmann | 40/152.1 |
| 2,633,653 | 4/1953 | Angus et al. | 40/155 |
| 2,641,427 | 6/1953 | Krogh | 40/152.1 X |
| 2,791,051 | 5/1957 | Scheyer | 40/152.1 |
| 3,218,747 | 11/1965 | Cornfield | 40/152.1 |
| 3,698,114 | 10/1972 | Hirsch et al. | 40/155 |
| 3,745,680 | 7/1973 | Faust | 40/156 |
| 3,946,512 | 3/1976 | Shapiro | 40/152.1 |
| 3,955,298 | 5/1976 | Kapstad | 40/152 |
| 4,078,326 | 3/1978 | Reim | 40/152.1 |

*Primary Examiner*—Louis G. Mancene
*Assistant Examiner*—Wenceslao J. Contreras
*Attorney, Agent, or Firm*—Bauer & Amer

[57] ABSTRACT

In a picture frame, a portion of one of the side sections thereof is bent and is notched in order to provide means for supporting the picture frame on a nail that is driven into a wall surface. The bent portion of the frame section may be formed during an extrusion process or an extruded frame section may have a portion thereof bent as a separate step. The present invention comprises an improved picture frame as well as the method for making same.

1 Claim, 7 Drawing Figures

PICTURE FRAME AND METHOD FOR MAKING SAME

BACKGROUND OF THE INVENTION

1. Field of the Invention

This invention relates generally to picture frames and more particularly to a novel structure integral with at least one of the frame sections for supporting the frame on a wall as well as the method for making the novel picture frame.

2. Description of the Prior Art

There are presently many different forms of structure for supporting a picture frame on a vertical wall surface. One common form of prior art, particularly where the picture frame is made of wood, is a length of wire that is strung between two eyes that are threaded into the rear surface of the picture frame. While this form of prior art is perfectly acceptable for wooden frames, such construction does present some problems when dealing with plastic or metallic frames since it is somewhat more difficult to thread the eyes into frames made of these materials. For plastic and metallic frames, particularly those made of extruded channel-like sections that are joined together at the corners thereof, it is known to provide a pair of clips that engage the channels with loops being formed on each of the clips in order to accommodate a length of wire therebetween. One disadvantage relating to this form of prior art resides in the fact that the clips are generally supplied loose and are usually assembled by the purchaser of the frame. In assembling the frame, it is possible that the clips will not be mounted at exactly the same height on each of the opposed side sections of the frame so that there is a possibility that the picture will not hang perfectly straight. Of course, the same disadvantage applies to the eyes that are threaded into wooden frames. In addition, the separate clips, or the separate eyes in the case of a wooden frame, must be separately stocked and inventoried at some additional cost and are of course subject to loss since they are loose prior to the purchase of the frame. Where these prior art forms of hanging means are assembled by the manufacturer of the frames, there is of course an attendant increase in the cost of the frame due to the additional labor that is required.

Still another form of prior art is disclosed in U.S. Pat. No. 3,031,159 granted on Apr. 24, 1962, to Arthur Waller. In this issued U.S. patent, there is disclosed an elongated strap that is secured to the rear surface of the member that is to be mounted. The main body portion of the strap is spaced away from the rear surface of the object to be mounted by means of a pair of outboard, offset legs and is provided on the lower edge thereof with a plurality of notches. One of the notches is arranged to engage a fastener, such as a nail, that is driven into the wall. It will be evident from a reading of the aforementioned U.S. patent that there are several defects in the prior art structure. First of all, great care must be taken when securing the strap to the rear surface of the object that is to be mounted. The strap must be perfectly centered and should be parallel to the top edge of the object to be mounted. Moreover, it is entirely possible for the strap to come loose since it is secured to the object to be mounted by means of screws and, quite frequently, the object to be mounted is relatively thin so that very small screws must be used. This form of prior art is limited in its application since the object to be mounted must be relatively thick in order to accommodate fasteners. That is, the prior art strap is usually mounted directly on the rear surface of the object and not on the frame sections thereof.

Still another example of a picture hanger is disclosed in U.S. Pat. No. 2,641,427 granted on June 9, 1953, to J. I. Krogh. In this last mentioned U.S. patent, a first strap is secured to a vertical wall surface and is provided with a pair of fasteners the heads of which are spaced from the first strap. A second strap having a plurality of open notches formed along one edge thereof is secured to the rear surface of the object that is to be mounted so that the notches in the second strap may engage and be supported by the shanks of the screws provided in the first strap. The head of the screws provided in the first strap prevent the picture to be mounted from being removed from the wall unless the picture is moved upwardly so as to disengage the second strap from the two screws. This second form of prior art suffers many of the defects of the Waller patent in that the second strap must be very accurately placed on the frame. In addition, the first strap must be very accurately placed on the wall. These requirements make the Krogh structure relatively difficult to use and somewhat more expensive than the Waller structure in that two straps must be manufactured and assembled.

SUMMARY OF THE INVENTION

The present invention overcomes the shortcomings described hereinabove with respect to the prior art by providing integral and unitary hanging means that does not require assembly. In the present invention, one leg of at least one of the side sections of an extruded frame is positioned in a plane that is substantially perpendicular to the plane of the outer, peripheral surface of the frame. That is, the leg is formed so that the plane thereof is substantially parallel to the plane of the wall when the picture is mounted thereon. In one embodiment of the present invention, at least a portion of one of the legs formed unitary with at least one of the frame sections is bent after it is extruded. In another embodiment of the present invention, the leg referred to hereinabove is unitarily extruded in the desired position. A portion of the free edge of the bent leg referred to hereinabove in connection with both embodiments of the invention is provided with a plurality of notches having their open ends facing in a direction away from the outer, peripheral surface of the frame.

The present invention, either embodiment thereof, is equally adaptable to metallic and plastic frames in that the side sections thereof are readily extrudable while wood is readily formed by multiple or ganged saws. It will also be evident that the present invention overcomes the shortcomings of the prior art described hereinabove in that the notched portion on which the frame will be supported is an integral part of one of the side sections of the frame. That is, the notched portion is not a separate component that is attached to the frame but is formed as a unitary part of the same. Accordingly, suitable jigs or fixtures may be used for accurately locating the notched portion during the course of manufacture, although accuracy of location is not required. Therefore, it is not left to the ultimate purchaser of the frame to assemble accurately the hanger to the frame.

In its broadest aspect, the present invention contemplates both the method for making the frame as well as the frame itself. That is, the notched portion may be bent after the frame section is extruded or the frame sections may be extruded with a portion that is the equivalent of the bent portion as an integral and unitary part of one of the legs thereof.

It is, therefore, an object of the present invention to provide an improved picture frame having unitary, integral hanging means.

It is another object of the present invention to provide an improved picture frame, as described above, wherein the frame sections are extruded.

Yet another object of the present invention is to provide an improved picture frame, as described above, wherein a portion of one of the legs is extruded in the substantial equivalent of a bent position.

A still further object of the present invention is to provide an improved picture frame, as described above, wherein a portion of at least one of the legs thereof is bent after extrusion.

A feature of the present invention is the provision of a saw tooth portion integral with at least one of the frame sections whereby the frame may be hung without further attachments being made thereto.

An advantage of the present invention resides in the fact that the means for hanging the frame is integral and unitarily formed therewith so that accurate measurements need not be made by the ultimate purchaser.

Another advantage of the present invention is that the basic concept is equally adaptable to both plastic and metal frames.

The above description, as well as further objects, features and advantages of the present invention, will be more fully appreciated by reference to the following detailed description of two presently preferred, but nonetheless illustrative, embodiments in accordance with the present invention when taken in conjunction with the accompanying drawings.

BRIEF DESCRIPTION OF THE DRAWINGS

In the drawings, wherein the same reference numeral denotes the same element throughout the several views.

DETAILED DESCRIPTION OF THE PREFERRED EMBODIMENTS

Figure 1:
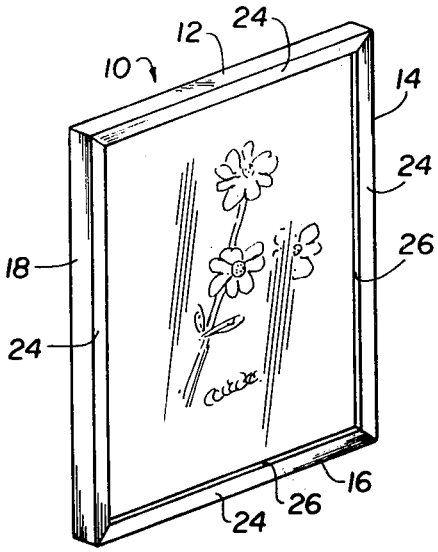
FIG. 1 is a front perspective view illustrating one embodiment of the novel picture frame comprising the present invention.
Figure 2:
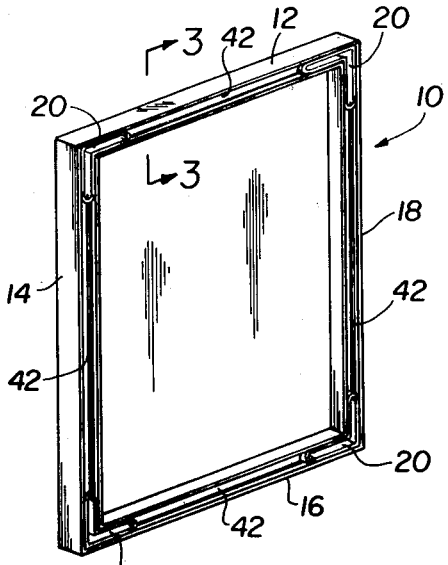
FIG. 2 is a rear perspective view of the picture frame shown in FIG. 1 prior to the bending and notching of one of the frame sections.

Referring to FIGS. 1 and 2, there is shown one embodiment of the picture frame 10 comprising the present invention. The picture frame 10 is made up of four side sections 12, 14, 16 and 18. The opposed ends of each of the side sections 12, 14, 16 and 18 are mitered in a conventional manner. L-shaped corner connectors 20 are utilized in a well known manner for coupling adjacent pairs of side sections 12 and 14, 14 and 16, 16 and 18, and 18 and 12 to each other.

Figure 3:
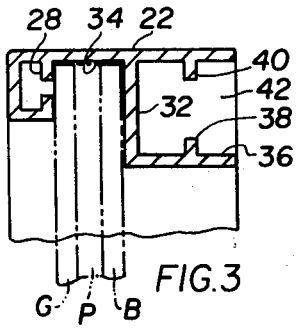
FIG. 3 is a fragmentary, sectional elevational view taken along line 3—3 of FIG. 2.

Reference may now be had to FIG. 3 which illustrates a typical side section of the picture frame 10. Since all of the side sections 12, 14, 16 and 18 are identical, a single description will suffice for all. Preferably, the side sections are extruded, either from metal or plastic. Each of the side sections 12, 14, 16 and 18 has an outer, peripheral surface 22. The front end of each side section is formed with an inwardly directed wall 24 which terminates in a rearwardly directed wall 26 that is substantially perpendicular thereto. A pair of inwardly and outwardly confronting ribs 28 and 30, respectively, are spaced rearwardly of the front wall 24 and are formed integrally with the outer peripheral wall 22 and the rearwardly extending wall 26, respectively.

Another transverse wall 32 is formed integrally with the outer peripheral wall 22 and is spaced rearwardly from the ribs 28 and 30 in order to define a channel 34 that is arranged to receive a piece of glass G, the picture P and a backing member B. Extending rearwardly from the wall 32 is yet another wall 36 that is spaced inwardly of and parallel to the outer, peripheral wall 22. A pair of outwardly and inwardly directed, confronting ribs 38 and 40, respectively, are formed integrally with the walls 36 and 22, respectively, in order to define in combination therewith an annular, marginal channel 42. It should be noted at this time that the corner connecting L-shaped members 20 are inserted in and force fit to be contained within the channel 42 locking about the ribs 38 and 40 to lock the sides together at their mitered corners in a conventional manner.

Figure 4:
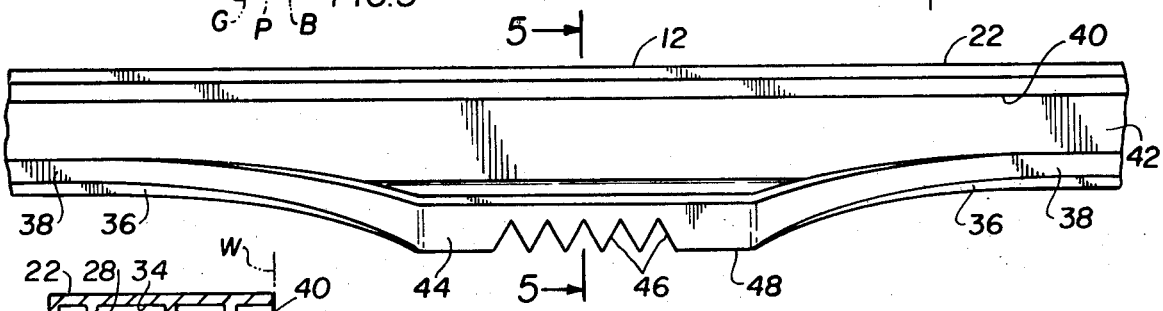
FIG. 4 is a fragmentary, elevational view, on enlarged scale, illustrating a portion of the picture frame comprising the first embodiment of the present invention after one of the frame sections thereof is bent and notched.
Figure 5:
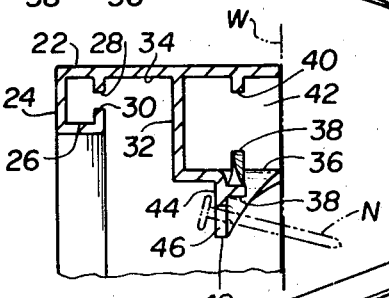
FIG. 5 is a sectional elevational view taken along line 5—5 of FIG. 4.
Figure 6:
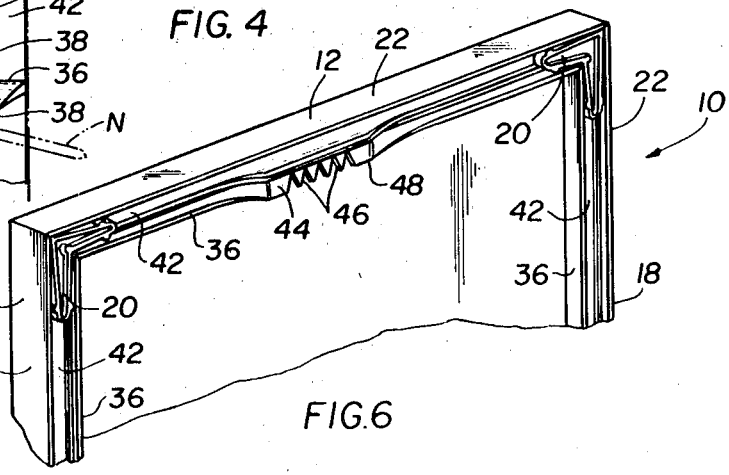
FIG. 6 is an enlarged fragmentary perspective view illustrating a portion of the picture frame comprising the first embodiment of the present invention.

In accordance with the first embodiment of the present invention, as shown for example in FIGS. 4 and 5, a portion of the rearwardly extending wall 36 is bent inwardly along and intermediate its ends so that, as shown in FIG. 5, the plane of the bent portion 44 of the remainder of the wall 36 is substantially perpendicular to the plane of the outer, peripheral wall 22 and is substantially parallel to the wall W on which the picture frame is to be mounted. As shown best in FIG. 4, a plurality of saw-tooth notches 46 are formed in the longitudinally extending edge 48 of the bent portion 44. The notches 46 are directed inwardly substantially in the plane of the rear of the frame and are arranged to be engaged by the shank of a fastener such as a nail N that is driven into the wall W as shown in FIG. 5. It will be evident that any one of the notches 46 may be selected to fit over the nail so that the picture may hang perfectly straight.

The first embodiment of the present invention described hereinabove in connection with FIGS. 1–6 may be fabricated from either an extruded metal such as an alluminum alloy or from a suitable plastic material. If fabricated from a metal, the wall 36 may be bent by the application of a suitable force using conventional equipment. If fabricated from a plastic material, the wall 36 may be bent by the application of heat and pressure. In either case, the first embodiment of the present invention is extruded with the wall 36 initially in the condition shown in FIG. 3. Thereafter, the wall 36 is bent at portion 44, after extrusion, to the position shown in FIG. 5.

Figure 7:
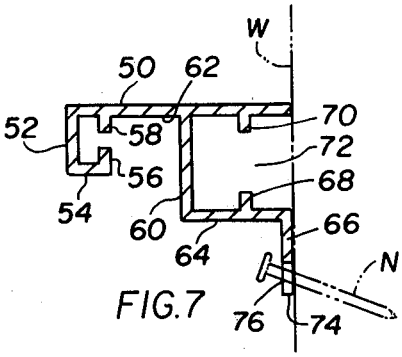
FIG. 7 is a sectional elevational view, similar in orientation to FIGS. 3 and 5 but illustrating an alternative embodiment of the present invention.

Alternatively, the present invention may be fabricated as shown in FIG. 7. In the second embodiment of this invention there is provided on each of the frame sections an outer, peripheral wall 50 having an integral front wall 52 formed at right angles thereto. A rearwardly extending wall 54 is formed at the free or inner end of the wall 52 and is provided with an outwardly directed rib 56 that is in confronting opposition with a rib 58 formed on the inside surface of the outer, peripheral wall 50.

Another wall 60 is formed integrally with the inside surface of the outer, peripheral wall 50 and is spaced rearwardly from the wall 52 in order to define, in combination with the confronting ribs 56 and 58, a channel 62 that is sized and shaped in order to accomodate a piece of glass, a picture and a backing board in the same manner as shown in connection with the embodiment illustrated by FIG. 3. Extending rearwardly from the wall 60 and at the inner end thereof there is provided still another wall 64 having an integrally and inwardly formed downwardly bent portion 66 that is formed during the extrusion process and is not bent during a separate step. Confronting ribs 68 and 70 are formed integrally with the walls 64 and 50, respectively, in order to define a channel 72 that is sized and shaped so as to accommodate the corner connecting members 22 for joining the sides together at their mitered corners.

The downwardly directed depending edge 74 of the bent wall portion 66 is provided with a plurality of notches 76 similar to the notches 46 shown in connection with the first embodiment of the present invention. Thus, a nail N driven into a wall W can be received in one of the notches 76 in order that the picture may be hung straight.

From the foregoing it will be appreciated that an improved picture frame and method for fabricating the picture frame has been provided. By virtue of the concept of the present invention, no assembly of hanging means need be made since a unitary portion of the frame itself is bent and notched in order to provide this function. In one embodiment of the present invention, a portion of one of the frame sections is bent after extrusion while in another embodiment in the present invention, the equivalent of the bent portion 66 of the frame section is formed during extrusion. Both embodiments of the present invention are adaptable to fabrication from either metal or plastic. Although not specifically illustrated, it will be readily appreciated that any one or more, as two adjacent frame sections, may be bent and notched in the manner described hereinabove so that the picture frame may be hung either horizontally or vertically. Because of the construction of the present invention, the cost of the frame is reduced in that no separate component is required for hanging the frame.

While there have been shown and described and pointed out the fundamental novel features of the invention as applied to two embodiments thereof, it will be understood that various omissions and substitutions and changes in the form and details of the device illustrated and its method of manufacture may be made by those skilled in the art without departing from the spirit of the invention. It is the intention, therefore, to be limited only as indicated by the scope of the claims appended hereto.

What is claimed is:

1. In a frame having a plurality of essentially separable sides each of which is connected together to form a completed frame for supporting a picture or the like in a plane, the invention comprising, each of said sides having retaining means for supporting a picture in the plane of the frame, connecting means to engage two adjacent sides at the ends thereof to releasably couple the same together to form the completed frame, each of said sides including a channel defined therein and having rib means extending into said channel such that when said connecting means is inserted into the channel of adjacent sides for forming the frame the same engage said ribs means with a locking force fit, at least one of said sides having a lengthwise support spaced rearward of said retaining means and extending substantially parallel with the plane of the frame, a plurality of notched supports of substantially sawtooth shape on said lengthwise support and extending for a portion thereof to enable at least one of said teeth to engage a mounting member to support said frame therefrom, and said notched supports and lengthwise support of said one side all being formed unitary and integral with each other although said one side is separate from said other plurality of sides with which the same is connected to form the completed frame, said lengthwise support being bent intermediate the ends of said one of said side sections with the remaining lengthwise portions of said one side section remaining in the same plane from which said support was bent.

* * * * *